US008024818B1

(12) United States Patent
Davenport

(10) Patent No.: US 8,024,818 B1
(45) Date of Patent: Sep. 27, 2011

(54) RETRACTABLE NECKPIECE FOR HEADWEAR

(75) Inventor: Steven Roy Davenport, Yukon, OK (US)

(73) Assignee: Davenport Innovations, Inc., Yukon, OK (US)

( * ) Notice: Subject to any disclaimer, the term of this patent is extended or adjusted under 35 U.S.C. 154(b) by 1003 days.

(21) Appl. No.: 11/772,027

(22) Filed: Jun. 29, 2007

Related U.S. Application Data

(60) Provisional application No. 60/839,164, filed on Aug. 22, 2006.

(51) Int. Cl.
*A42B 1/06* (2006.01)

(52) U.S. Cl. ..... 2/172; 2/207; 2/209.13

(58) Field of Classification Search ..... 2/209.13, 2/172, 181.4, 175.6, 422, 206, 207
See application file for complete search history.

(56) References Cited

U.S. PATENT DOCUMENTS

| | | | | | |
|---|---|---|---|---|---|
| 889,640 | A * | 6/1908 | Sherman | 2/172 |
| 1,909,686 | A * | 5/1933 | Kindall | 2/172 |
| 2,055,560 | A * | 9/1936 | Rose | 2/206 |
| 5,046,195 | A * | 9/1991 | Koritan | 2/172 |
| 5,081,717 | A * | 1/1992 | Shedd et al. | 2/181.4 |
| 5,121,507 | A | 6/1992 | Brown | |
| 5,153,943 | A * | 10/1992 | Clement | 2/418 |
| 5,161,259 | A * | 11/1992 | Shorts | 2/172 |
| 5,201,077 | A * | 4/1993 | Dondlinger | 2/209.3 |
| 5,287,559 | A * | 2/1994 | Christiansen et al. | 2/181 |
| 5,355,535 | A * | 10/1994 | Bruder | 2/172 |
| 5,448,778 | A * | 9/1995 | Phillips | 2/172 |
| 5,493,734 | A * | 2/1996 | Nieves-Rivera | 2/209.13 |
| 5,603,120 | A * | 2/1997 | Gifford | 2/172 |
| 5,649,327 | A | 7/1997 | Crewe | |
| 5,655,225 | A * | 8/1997 | Mathers | 2/172 |
| 5,669,074 | A | 9/1997 | Newman, Jr. | |
| 5,887,287 | A * | 3/1999 | Potochnik | 2/209.13 |
| 5,950,242 | A * | 9/1999 | Mahoney | 2/209.13 |
| 6,021,525 | A * | 2/2000 | Mertins | 2/172 |
| 6,163,886 | A * | 12/2000 | Carter | 2/172 |
| 6,233,745 | B1 * | 5/2001 | Friesen | 2/172 |
| 6,442,762 | B1 * | 9/2002 | Neumann | 2/175.7 |
| 6,802,083 | B2 * | 10/2004 | Yan | 2/209.13 |
| 6,857,134 | B1 * | 2/2005 | Cowell | 2/209.13 |
| 7,310,829 | B1 * | 12/2007 | Engel-Wilson | 2/209.13 |
| 7,578,007 | B2 * | 8/2009 | McIntyre | 2/181.4 |
| 2004/0244095 | A1 * | 12/2004 | Sonne et al. | 2/175.4 |

* cited by examiner

*Primary Examiner* — Katherine Moran
*Assistant Examiner* — Richale L Quinn
(74) *Attorney, Agent, or Firm* — Fellers, Snider, et al.

(57) ABSTRACT

Apparatus for shading a user's neck. In some embodiments, a support device comprises a flexible, generally U-shaped structure with a laterally extending central portion to accommodate attachment of a proximal edge of a neckpiece, and opposing leg portions which extend from the central portion to engage the headwear. In further embodiments, the neckpiece preferably comprises a layer of flexible material with a proximal end supported adjacent a headwear and an opposing distal end configured to be suspended adjacent to a base of the user's neck. A support portion is formed from laterally extending first and second panels which fold together to form a V-shaped channel circumferentially extending in contact against an outermost rearward surface of the headwear. A flap portion extending from the second panel is moveable between a deployed state to cover the user's neck to a retracted state in which the flap portion is gathered into the channel.

17 Claims, 21 Drawing Sheets

RETRACTABLE NECKPIECE FOR HEADWEAR

RELATED APPLICATIONS

The present application makes a claim of domestic priority to U.S. Provisional Patent Application No. 60/839,164 filed Aug. 22, 2006, which is hereby incorporated by reference.

BACKGROUND

Various forms of sports-related headwear, such as ball caps, remain popular for outdoor use. A number of neck shade arrangements have been proposed for use with a headwear piece to protect the neck of the wearer from environmental elements (such as sun, wind, rain, cold, etc.).

Such neck shade arrangements can be removable or permanently affixed to the headwear, and in most cases generally perform an adequate job of protecting the user's neck when deployed. However, it appears that few neck shade arrangements provide a way to store the arrangements when not in use, and those that do generally fail to do so in an aesthetically pleasing manner.

SUMMARY

Accordingly, various embodiments of the present invention are generally directed to an apparatus for shading a user's neck.

In accordance with some embodiments, a support device comprises a flexible, generally U-shaped structure with a laterally extending central portion to accommodate attachment of a proximal edge of a neckpiece, and opposing leg portions which extend from the central portion to engage the headwear.

In further embodiments, the neckpiece preferably comprises a layer of flexible material with a proximal end supported adjacent a headwear and an opposing distal end configured to be suspended adjacent to a base of the user's neck. A support portion is formed from laterally extending first and second panels which fold together to form a V-shaped channel circumferentially extending in contact against an outermost rearward surface of the headwear. A flap portion extending from the second panel is moveable between a deployed state to cover the user's neck to a retracted state in which the flap portion is gathered into the channel.

DETAILED DESCRIPTION

The detailed description set forth below in connection with the appended drawings is intended merely as a description of presently preferred embodiments of the present invention, and is not limiting to the claimed subject matter set forth below.

Figure 1:
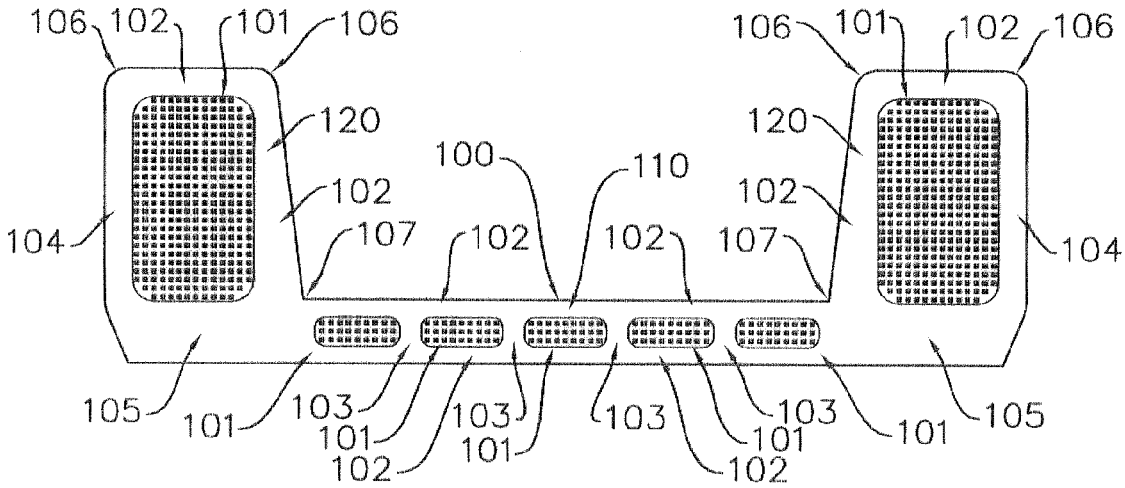
FIG. 1 is a flat planar view of an exemplary support device constructed in accordance with various embodiments of the present invention, the support device having a generalized U-shape configuration.

FIGS. 1 and 2 generally illustrate a support device 100 according to some embodiments. The support device 100 is generally configured to engage a rearward portion of a headwear, such as a ball cap, and is formed from a suitable flexible material such as injection molded plastic. The support device 100 is preferably provided with an overall planar shape that may be characterized as a U-shape, with a laterally extending central portion 110 and opposing leg portions 120.

Mesh areas are generally denoted at 101. The mesh areas 101 each comprise an array of square, round or other suitably shaped openings through the support device material. Although not required, the mesh areas 101 generally promote wicking of perspiration from the user's head, and generally enhance flexibility of the support device 100 in these areas.

Solid banding areas 102 extend along the full perimeter of the support device 100, and solid banding areas 103 are further provided along interior portions of the support device between adjacent mesh areas 101. Solid banding reinforcing strips 104 are provisioned at each end of the support device 100, as are solid closure-attachment areas 105. Radius 106 accommodates a bottom edge of the headwear, as further shown below.

Figures 2A, 2B:
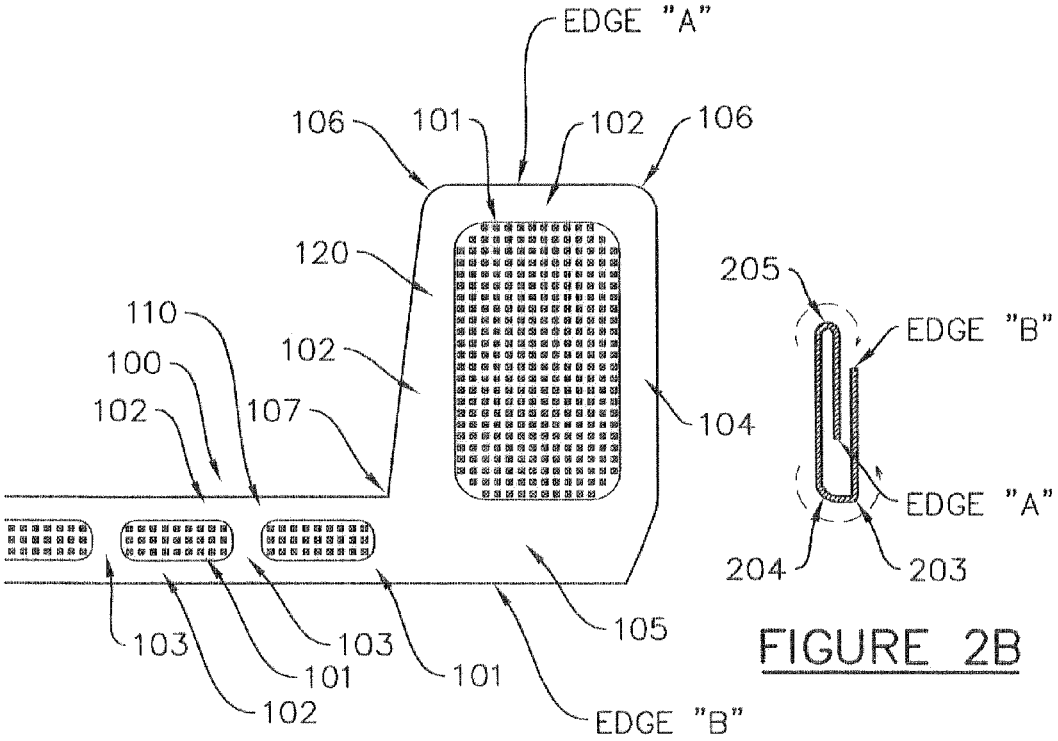
FIG. 2A provides a partial plan view of the support device of FIG. 1.
FIG. 2B provides a corresponding end view of the support device to illustrate a generalized G-shape configuration thereof.

FIG. 2A is a partial flat pattern view of the support device 100. FIG. 2B shows an end sectional view of the support device 100 in a final "rolled," or "loosely folded," circuitous configuration. Reference is made to the respective notations of edge A and edge B on the partial, flat pattern view of FIG. 2A and the sectional view of FIG. 2B. The circuitous configuration can be readily formed using any number of suitable processes, such as molding or roll forming, with or without the application of suitable levels of heat and/or pressure. The resulting shape shown in the sectional view of FIG. 2B is generally described herein as a G-shape.

A sharp corner 107 (FIG. 1) preferably facilitates the folding of the leg portions 120 to the G-shape shown in FIG. 2B. Further radii are denoted at 203, 204 and 205 to facilitate forming and retention of the G-shape. When a folding type process is used, the required rotations of the respective surfaces are depicted in FIG. 2B via rotational arrows.

Figure 3:
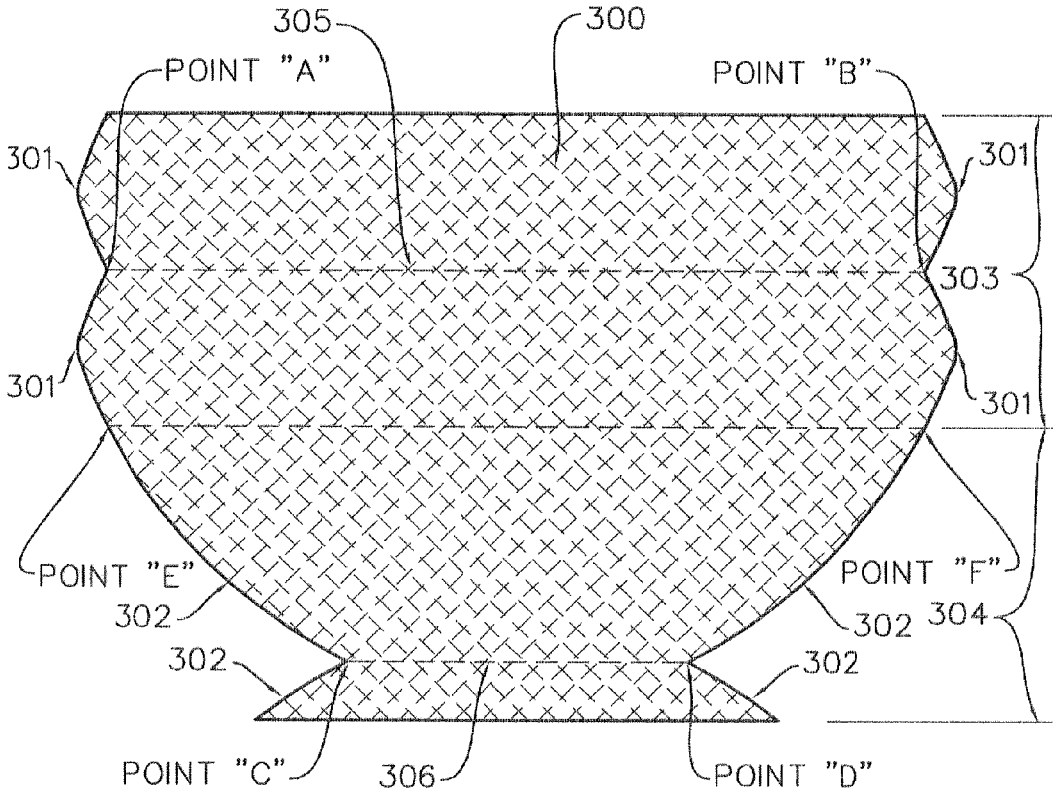
FIG. 3 illustrates an exemplary neckpiece for use with the support device of FIG. 1, with the neckpiece of FIG. 3 in an unfinished state.

FIG. 3 is a flat pattern view of an exemplary unfinished fabric neckpiece 300 for use in conjunction with the support device 100. The neckpiece 300 is formed from a suitable flexible material, such as cotton or other fabric cut in the general shape set forth in FIG. 3. Preferably, radiused corners 301 form matching corners to each other when the neckpiece 300 is folded along fold line 305 from point A to point B.

Figure 4:
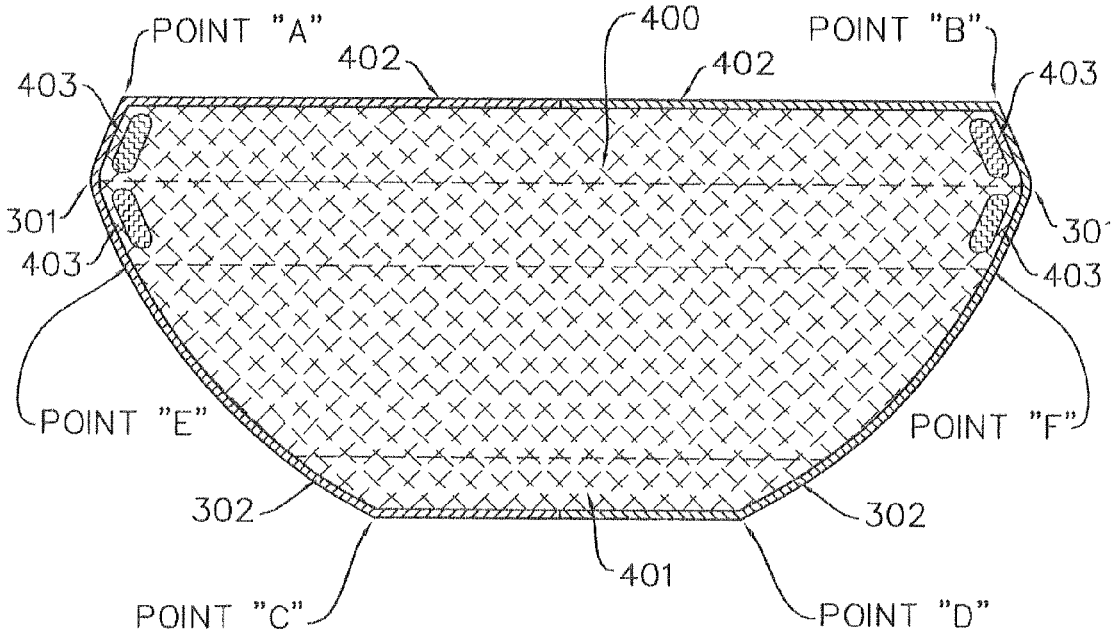
FIG. 4 represents the neckpiece of FIG. 3 in a finished state.

FIG. 4 shows the neckpiece in a final finished configuration at 400. Radiused corners 302 form matching corners to each other and when the neckpiece is folded along a fold line 306 from point C to point D, thereby forming a permanent starter strip 401 (FIG. 4) for use when storing the neckpiece.

FIG. 3 further shows two areas of the neckpiece 300 that are defined as a support section 303 and a flap section 304, which are preferably divided along a line from point E to point F. These areas are likewise noted in the final configuration of FIG. 4. It is contemplated that suitable edging, such as a sewn hem, adhesive binding, etc., can be applied to the respective edges of FIG. 3 to produce the configuration of FIG. 4.

FIG. 4 further shows closure devices at 403. The closure devices 403 generally operate to secure the neckpiece 400 in a retracted state in which the neckpiece 400 is stored. The closure devices 403 may be hook-and-loop type, metal or plastic snaps, magnets, etc. to facilitate closing the front edges and holding the device in a closed position when stored. The top two panels illustrated in FIG. 4 (also referred to herein as the "support portion") generally form a V-shaped channel into which remaining portions (also referred to herein as the "flap portion") of the neckpiece can be gathered via a flattened roll structure.

Figure 5:
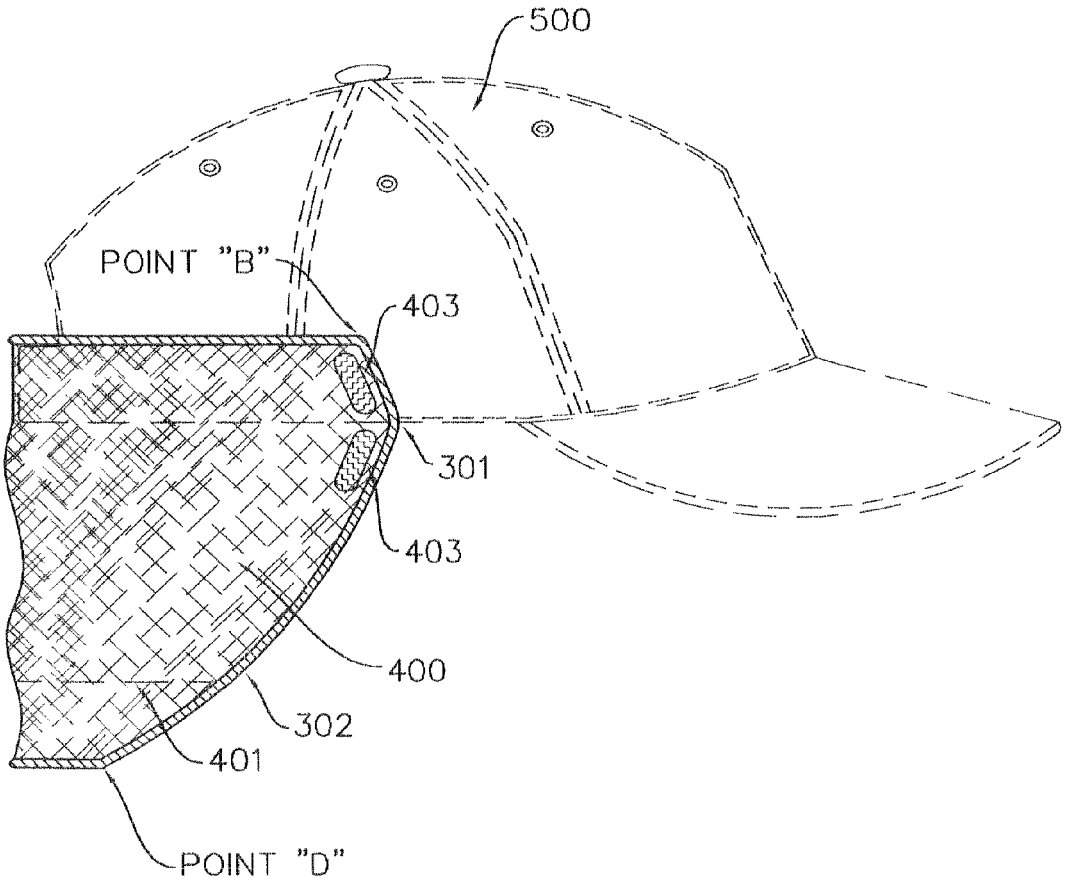
FIG. 5 shows the finished neckpiece of FIG. 4 affixed to a standard baseball-type cap using the support device of FIG. 1, with the neckpiece being in a deployed state.
Figure 6:
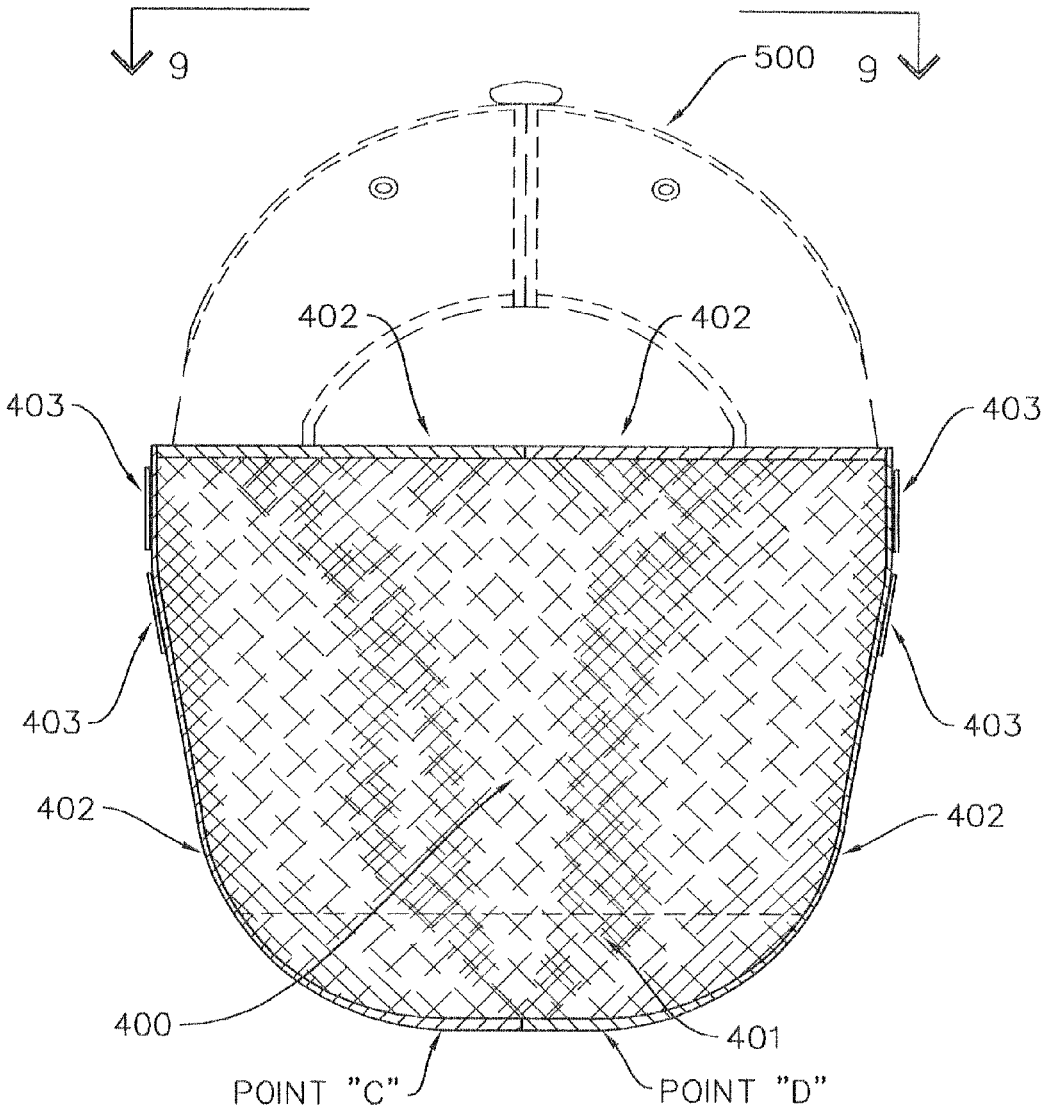
FIG. 6 shows a rear elevational view of the arrangement of FIG. 5.
Figure 7:
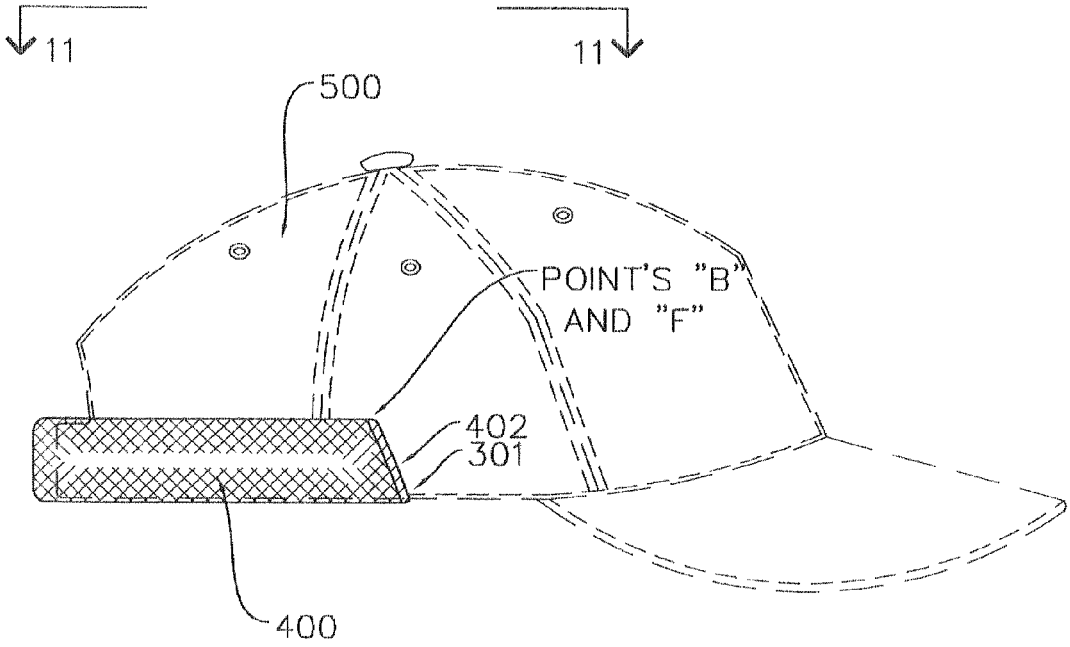
FIG. 7 shows the arrangement of FIGS. 4-5 in a retracted state so that the neckpiece is stored adjacent the cap.
Figure 8:
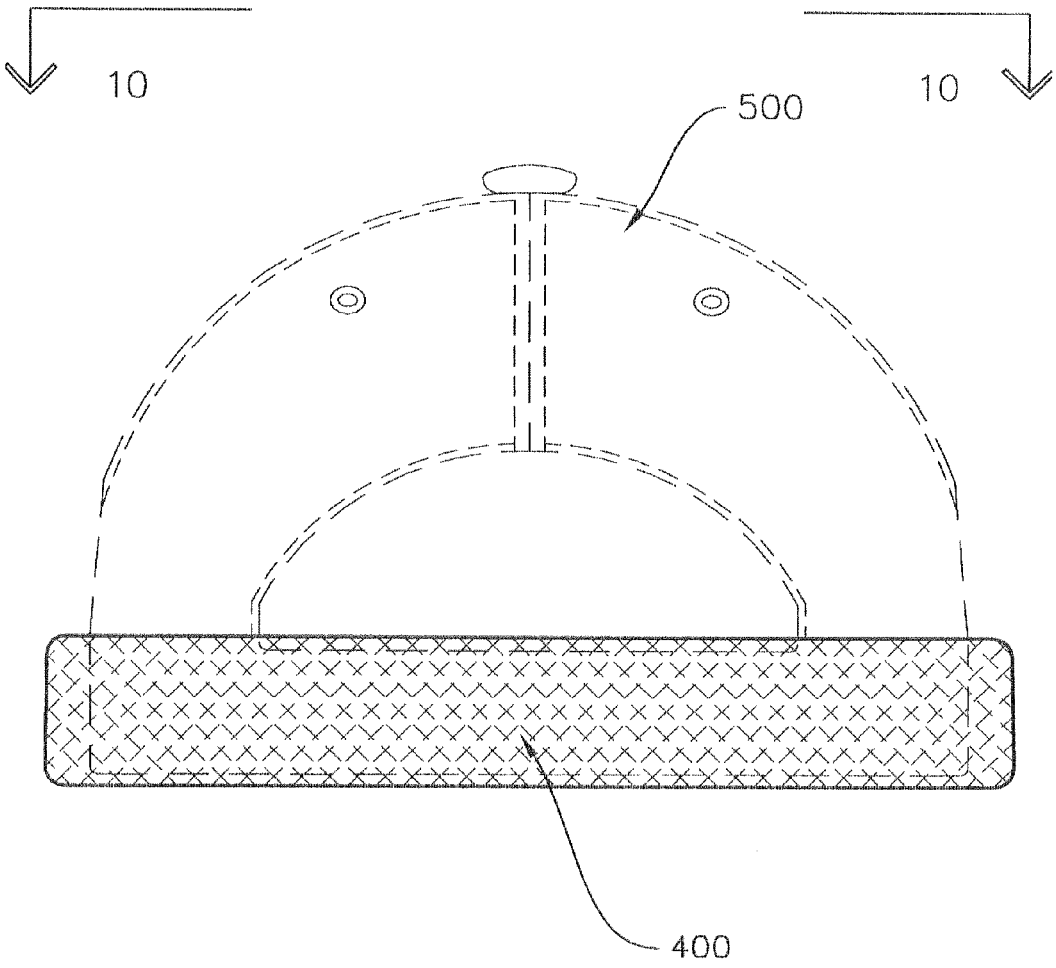
FIG. 8 sets forth a corresponding rear elevational view of the arrangement of FIG. 7.

FIGS. 5-6 generally illustrate the neckpiece 400 and support device 100 in conjunction with a headwear, in this case characterized as a standard baseball-type cap 500. The neckpiece is in the deployed state in these figures so as to cover at least a portion of the user's neck while the user wears the cap 500. FIGS. 7-8 correspondingly show the neckpiece 400 in the retracted (stored) state adjacent the cap 500.

Figure 9:
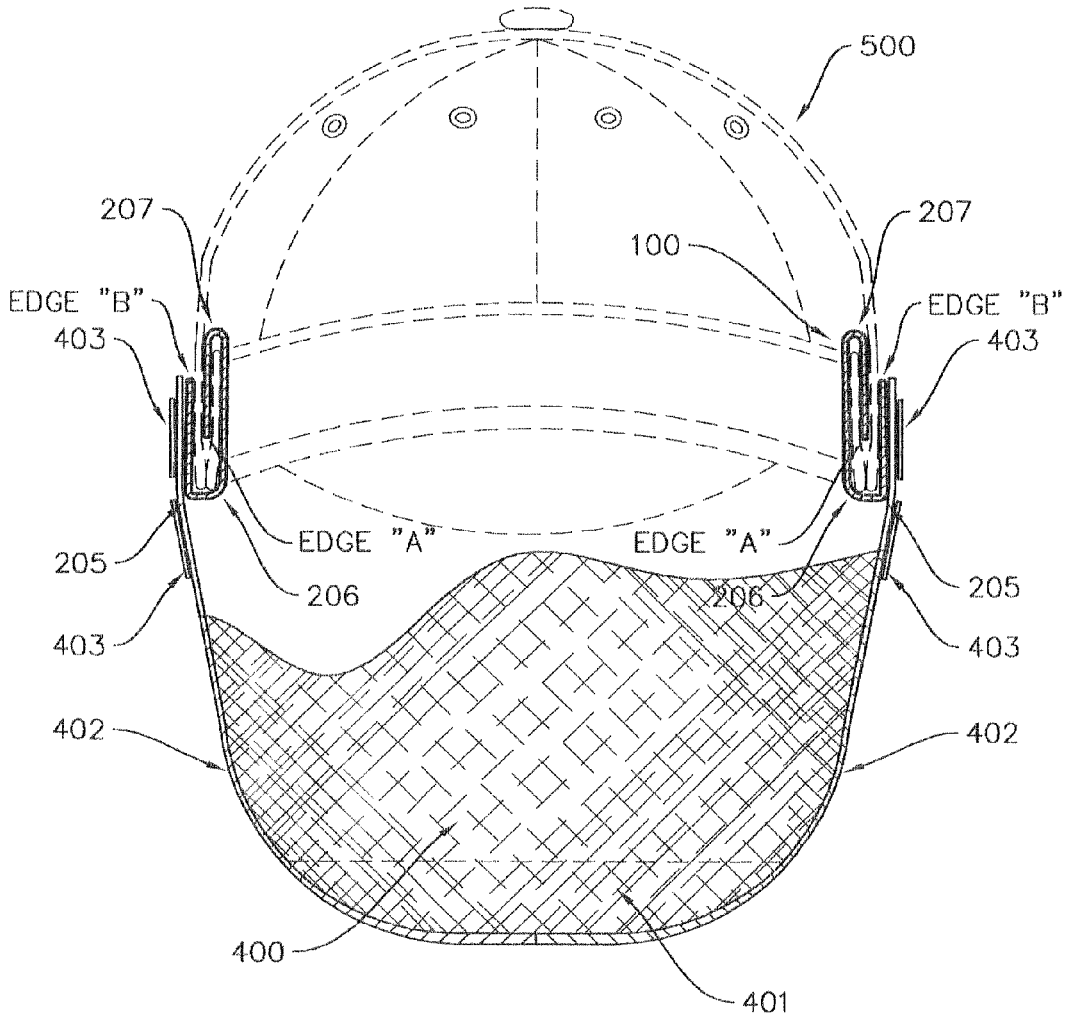
FIG. 9 provides a partial cross-sectional view of the cap, the support device, and the neckpiece in the deployed state.
Figure 10:
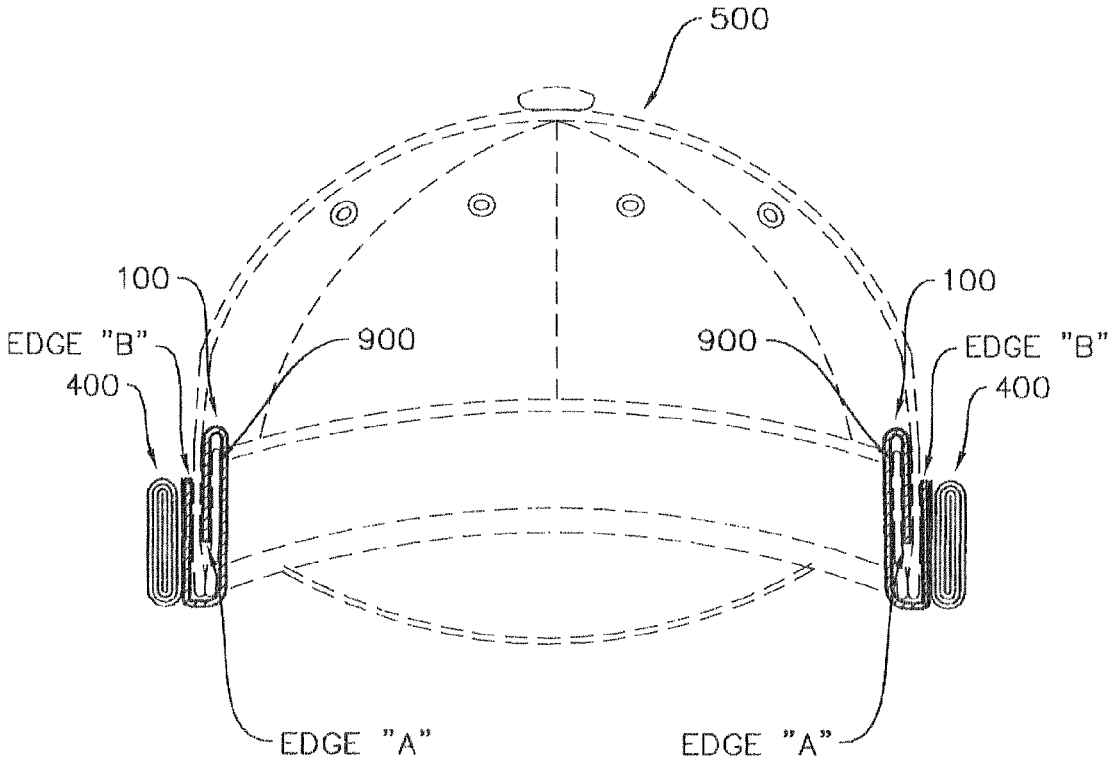
FIG. 10 is a corresponding partial cross-sectional view of the cap, support device and neckpiece in the retracted state.

The support device 100 is preferably affixed to the cap 500 as set forth in FIGS. 9 and 10. Generally, the G-shaped end portions of the support device extend upwardly, into, and down in the interior of the cap 500 to engage an internally disposed, upturned hat band 900 (FIG. 10). In the G-shape, a first flange extending from edge A is configured to form an overlapping relation with a second flange extending from edge B.

In this way, the support device 100 remains rigidly, removably affixed to the cap 500, with the laterally extending central portion 110 (FIG. 1) held against a curvilinearly extending, exterior surface of the cap 500 to support the neckpiece 400 (FIG. 4), and interior facing portions of the opposing leg portions 120 (FIG. 1) contactingly engaging the user's head in a comfortable manner. The uppermost strip of the neckpiece 400 is bonded to the laterally extending central portion 110 of the support device 100 using a suitable methodology such as via adhesive, sewing, sonic welding, etc.

As best shown in FIG. 10, the neckpiece 400 is transitioned from the deployed state to the retracted (stored) state by operation of the user to successively fold the neckpiece, using the permanent starter strip 401 as an initial guide. By folding the neckpiece as a series of uniform strips, the neckpiece 400 can advantageously be brought into the final configuration and secured therein using the closure devices 403. A bottom of the V-shaped channel formed by the top two panels (as illustrated in FIG. 4) may be disposed at a level substantially even with a bottom edge of the headwear.

The resulting configuration is flat, compact, and aesthetically pleasing to others who may observe the headwear combination as worn by the user. As desired, human readable indicia (sports team logos, etc.) can be provided to the neckpiece in suitable locations so as to be respectively viewable with the neckpiece 400 is in the deployed (FIG. 6) and/or retracted (FIG. 8) states. Other indicia can also be provided such as reflective material, strips, etc.

Figure 11:
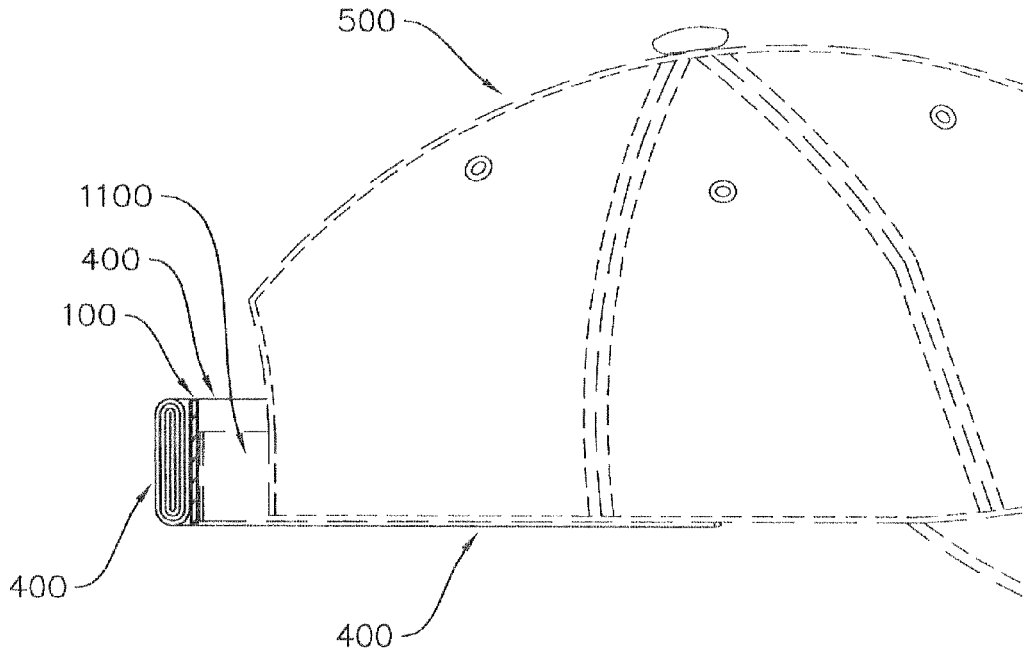
FIG. 11 is another view of the arrangement of FIG. 10.

The removable nature of the support device 100 advantageously permits the user to remove the support device 100 and neckpiece 400 from the cap 500 entirely, as desired, and be replaced at will on the same cap or provisioned on a different headwear. The removable nature of the support device 100 further readily accommodates caps that are adjustable in size; for example, as depicted in FIG. 11, the support device 100 readily conforms to a conventional cap adjustment strap/band 1100. In this way, the cap 500 can be adjusted to fit the head of the user, and the support device 100 can then be slidingly adjusted appropriately so as to lie adjacent the strap/band 1100.

Figure 12:
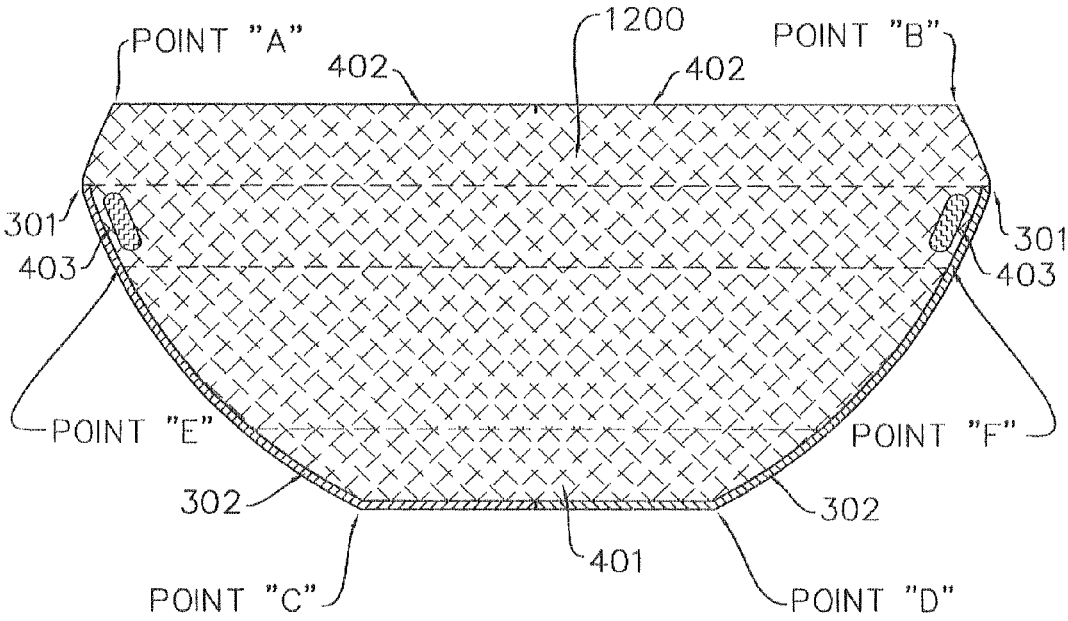
FIG. 12 sets forth a plan view of an alternative exemplary neckpiece configured to be permanently affixed to a headwear, such as the aforedescribed cap.

FIG. 12 provides an alternative embodiment in which a neckpiece 1200 is configured to be permanently affixed to a headwear, such as the aforementioned cap 500, without the use of the support device 100. FIG. 12 is a flat pattern view of the neckpiece 1200 cut from a suitable material/fabric stock prior to permanent attachment to the cap 500. The neckpiece 1200 may alternatively be produced in a final shape as shown in FIG. 12 without being cut from stock.

As before, radiused corners 301 form matching corners to each other when the neckpiece is folded along fold line 305 from point A to point B. Radiused corners 302 form matching corners to each other and when the neckpiece is folded along a fold line 306 from point C to point D, thereby forming the permanent starter strip 401. A support section 303 and flap section 304 are further divided along a line from point E to point F, as previously noted on FIG. 3. Closure devices 403 are denoted as before.

Figure 13:
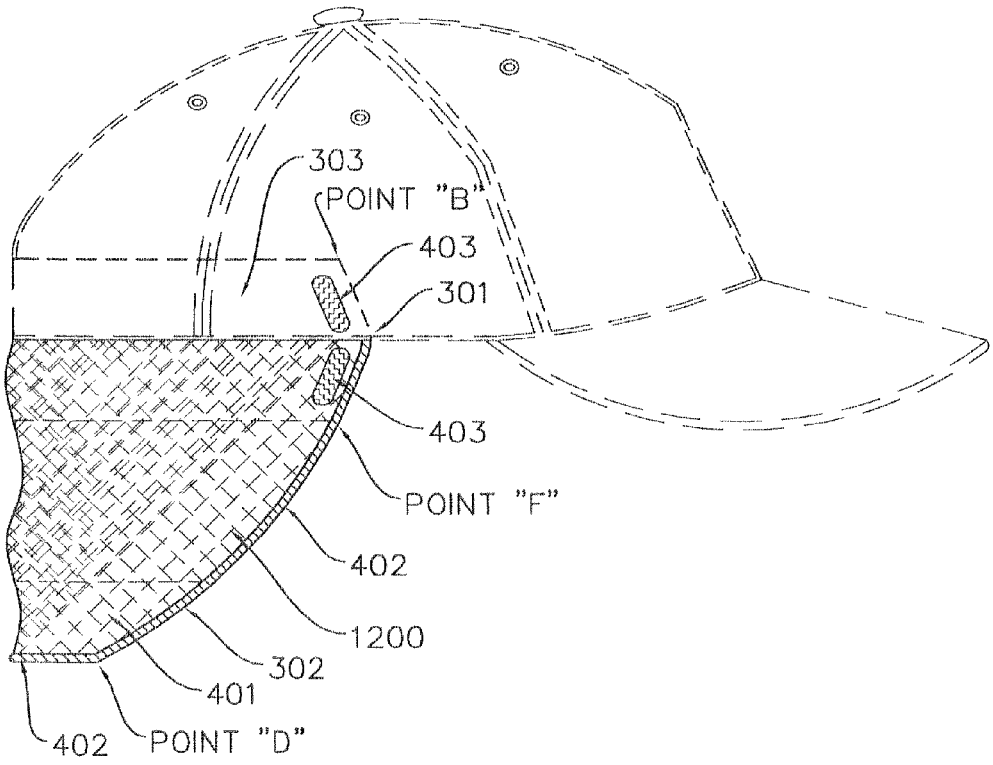
FIG. 13 is a side elevational view of the neckpiece of FIG. 12 in conjunction with the cap, with the neckpiece in the deployed state.
Figure 14:
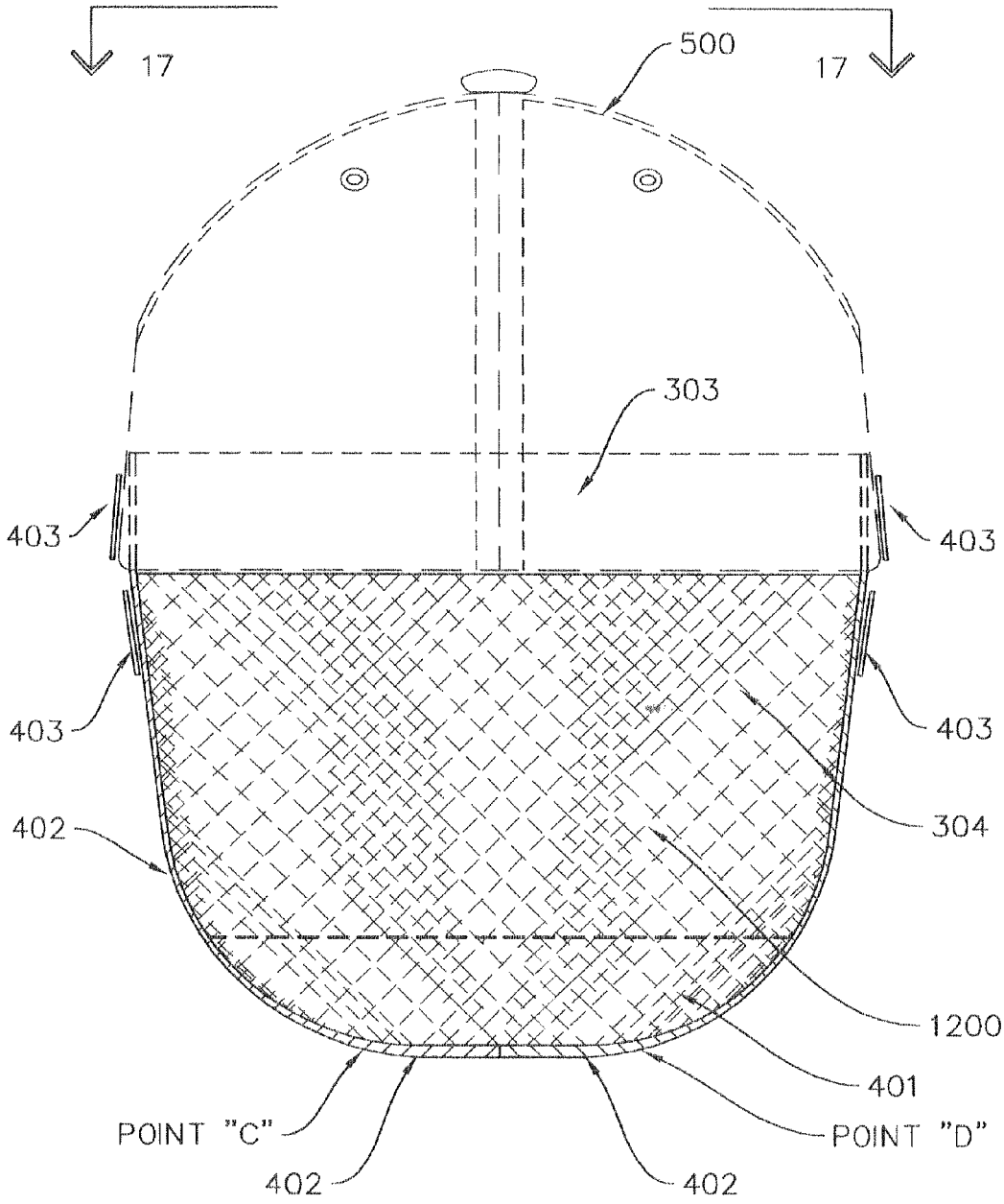
FIG. 14 is a rear elevational view of the arrangement of FIG. 13.
Figure 15:
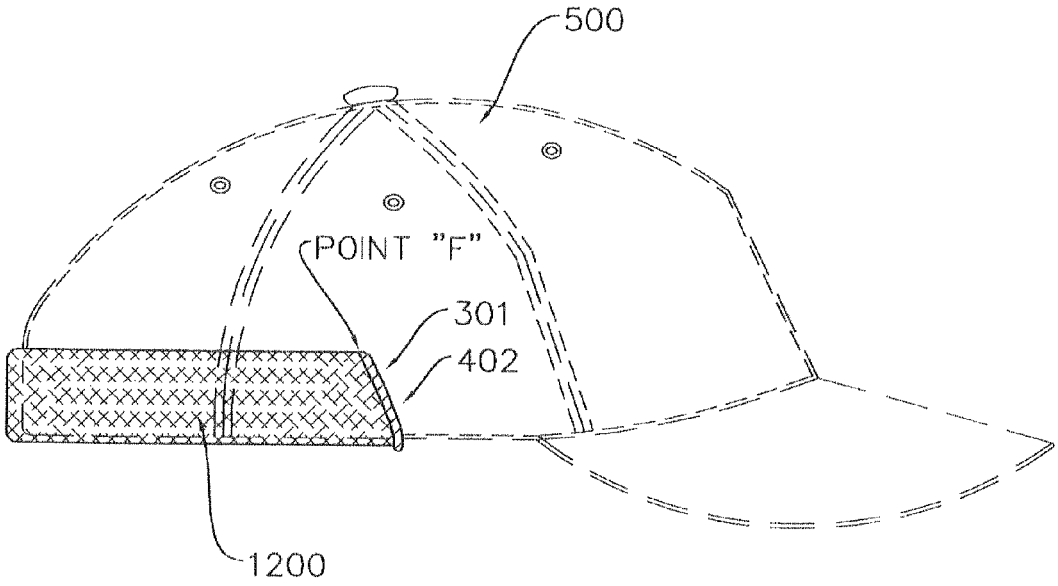
FIG. 15 is a corresponding, side elevational view of the arrangement of FIGS. 13-14 with the neckpiece in a retracted state.
Figure 16:
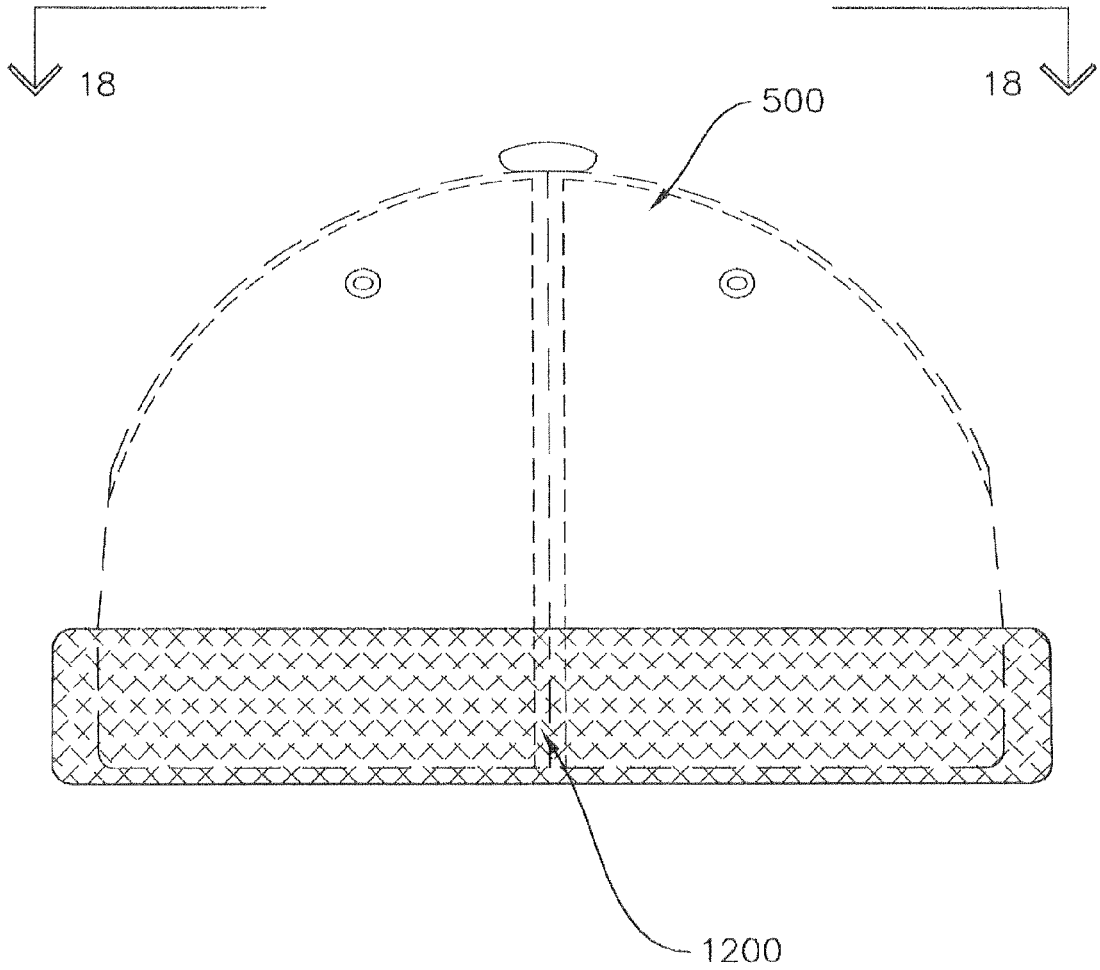
FIG. 16 provides a rear elevational view of the arrangement of FIG. 15.
Figure 17:
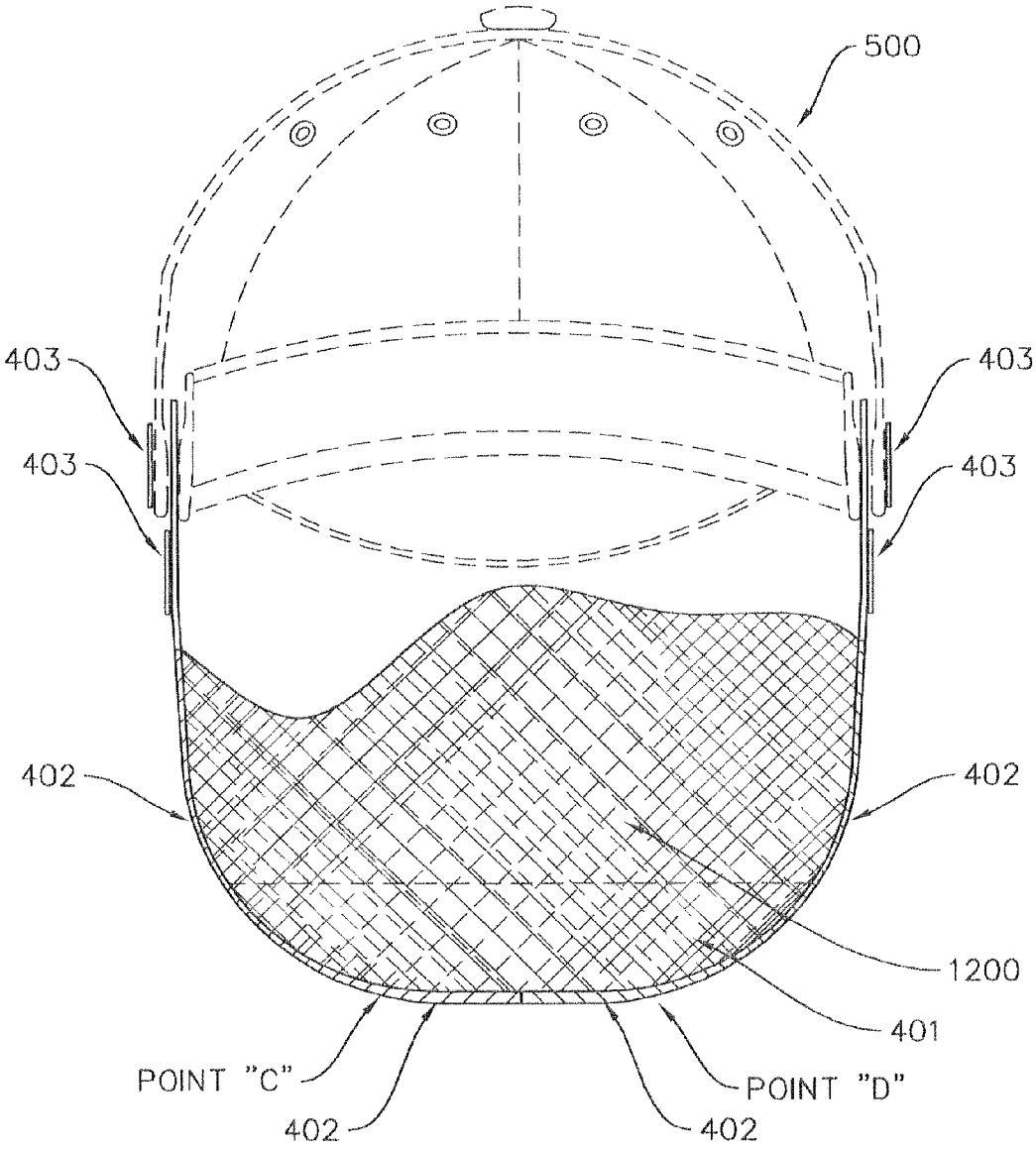
FIG. 17 is a partial cross-sectional view of the arrangement of FIG. 14.
Figure 18:
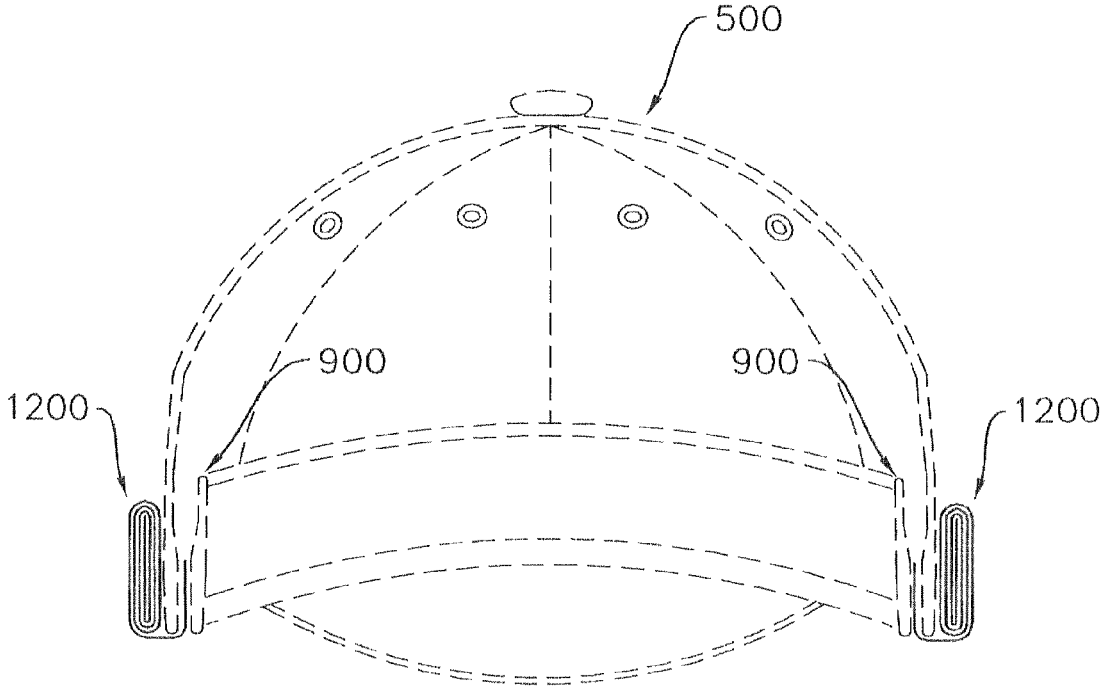
FIG. 18 is a corresponding rear partial cross-sectional view of the arrangement of FIG. 17.

FIGS. 13-14 show the neckpiece 1200 after being permanently affixed to the cap 500. The upper portion of the neckpiece 1200 can be bonded, such as via an adhesive or sewing operation, etc., to the cap 500 such as to the interior headband 900 (or other suitable location). Exteriorly disposed closure devices 403, as shown in FIG. 13, are preferably affixed to the exterior panels (gores) of the cap 500 to facilitate placement of the neckpiece 1200 in the retracted position, as generally depicted in FIGS. 15-16. FIGS. 17-18 show corresponding cross-sectional views to illustrate the respective placement of the closure devices 403.

Figure 19:
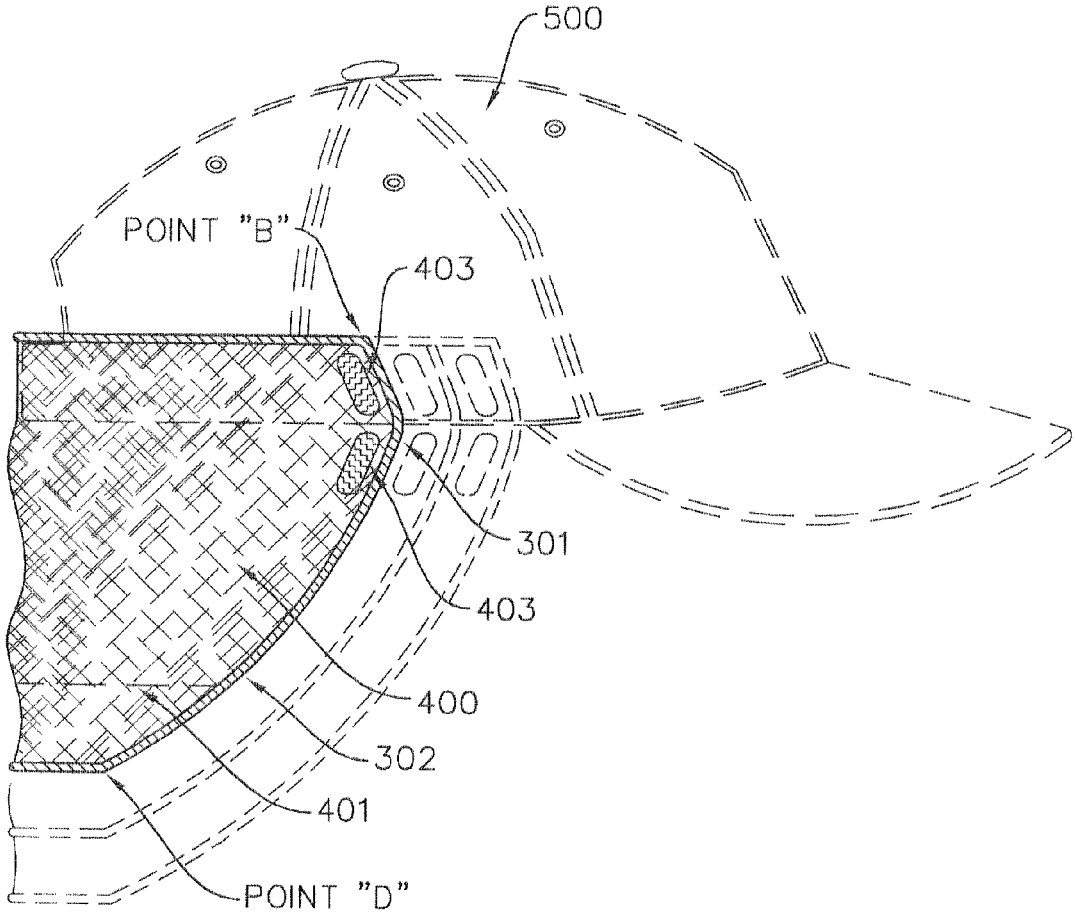
FIG. 19 generally illustrates different sizes and shapes for the neckpiece.

It will further be appreciated that both the removable neckpiece 400 and the permanently affixed neckpiece 1200 can be readily provided in a number of different shapes and sizes, such as generally illustrated in FIG. 19.

Figure 20A:
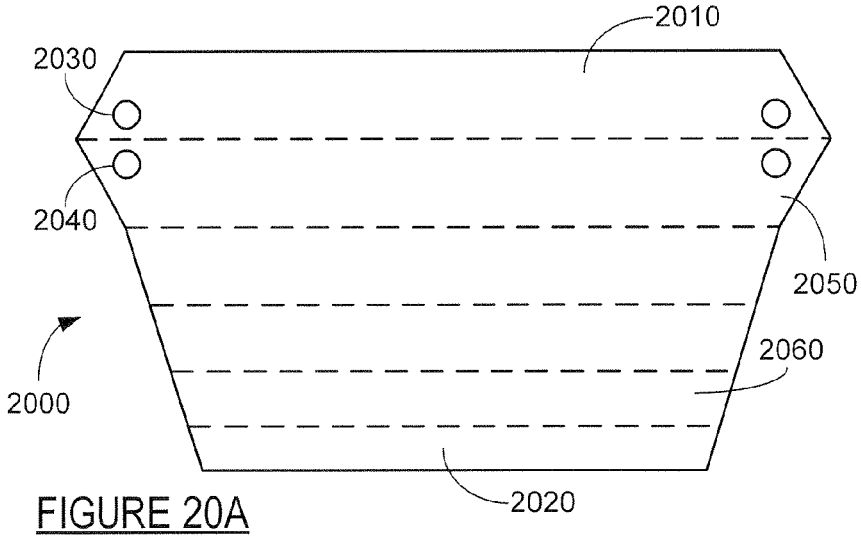
FIGS. 20A-20F generally illustrate another exemplary neckpiece to further illustrate a preferred transition methodology between the deployed and retracted states.

FIGS. 20A-F provide additional details with regard to transitioning the neckpiece between a deployed state and a retracted state. An exemplary neckpiece is denoted therein at 2000, and is generally similar to the neckpieces 400, 1200 discussed above. In FIG. 20A, the neckpiece 2000 is shown to be in the fully deployed state, with a proximal end 2010 supported adjacent the headwear (e.g., cap 500), either in a permanently affixed or removable fashion. The neckpiece 2000 further includes an opposing distal end 2020 which is configured to be suspended adjacent a base of the user's neck while the neckpiece is in the deployed state.

As discussed previously, the neckpiece 2000 is generally divided into a plurality of adjacent laterally extending panels with fold regions therebetween, as denoted by broken lines in FIG. 20A. Closure devices 2030, 2040 are respectively disposed on the topmost panel adjacent the proximal edge 2010 and an adjacent panel 2050, as shown.

Figure 20B:
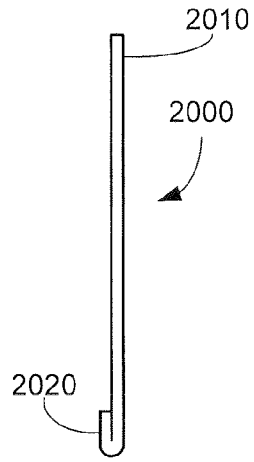

The bottommost panel adjacent the distal edge 2020 is preferably folded over or otherwise "doubled" in thickness, such as shown in FIG. 20B, to provide a permanent guide for the user during retraction (storage) of the neckpiece 2000, as before. The panels can all have the same width (as measured in the vertical direction between respective edges 2010 and 2020), or can be of successively increasing width, as shown in FIG. 20A.

Figure 20C:
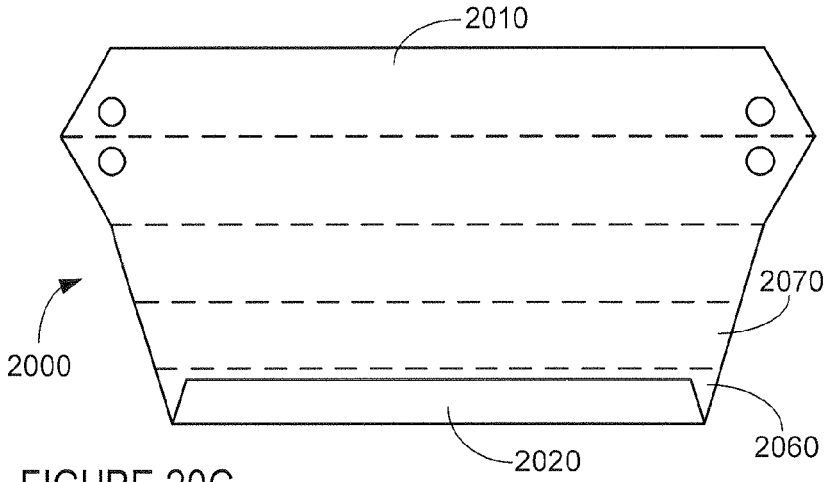
Figure 20D:
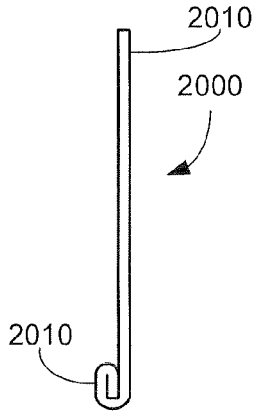
Figure 20E:
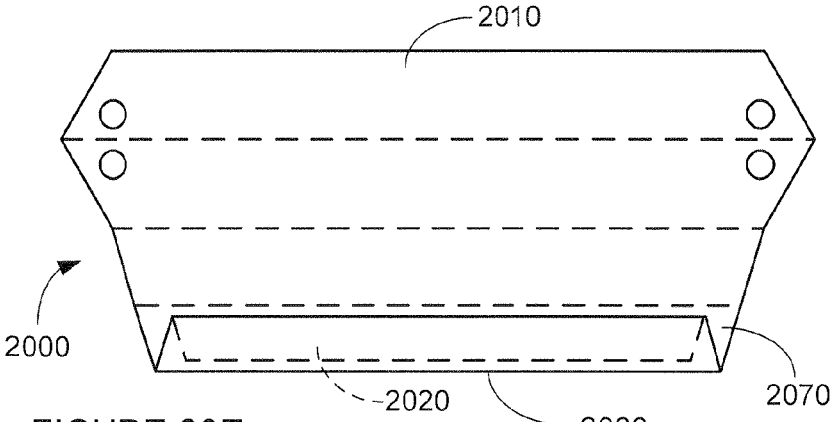
Figure 20F:
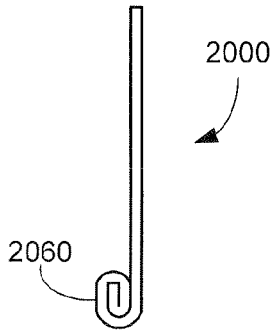

To transition the neckpiece 2000 to the retracted state, the user successively folds the plurality of adjacent panels along said fold regions, beginning with the panel adjacent the distal edge 2020, to form a flattened roll structure that increases in thickness after each fold. The first folding step is generally depicted by FIGS. 20C and 20D, and the second folding step is generally depicted in FIGS. 20E and 20F. The final configuration of the flattened roll structure will generally take a form as previously noted in FIGS. 10 and 18.

The neckpiece 2000 preferably tapers so that the proximal edge 2010 is greater in length than the distal edge 2020. This provides clearance for the respective closure devices 2030, 2040 to contactingly engage when the panel 2050 is brought into abutment with the uppermost panel adjacent proximal edge 2010, and prevents the side stitching/trimming from "stacking" as the neckpiece is successively folded. As with the neckpieces 400, 1200, it will be appreciated that these latter two panels of the neckpiece 2000 form an upwardly directed, open channel to retain the folded structure in the stored, retracted state. It will be noted that the channel is formed irrespective of whether the neckpiece is permanently affixed or removable from the headwear.

FIGS. 21A-21D show another exemplary neckpiece 2100 generally similar to the neckpieces 400, 1200 and 2000, and includes opposing proximal and distal edges 2110, 2120, as before. The neckpiece 2100, however, includes an elongated roll member 2130 adjacent the distal edge 2120. As further shown in FIG. 21B, the roll member 2130 preferably comprises a lightweight, flexible cylindrical rod, such as formed from rubber tubing or similar. Other constructions and cross-sectional shapes can readily be used, however, including square, oval, etc.

Figure 21A:
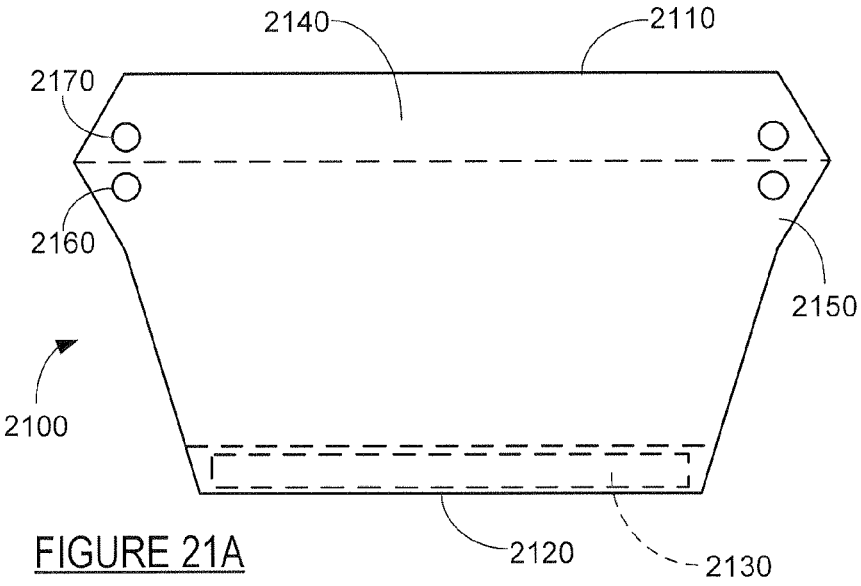
FIGS. 21A-21D generally illustrate another exemplary neckpiece to illustrate an alternative preferred transition methodology between the deployed and retracted states.
Figure 21B:
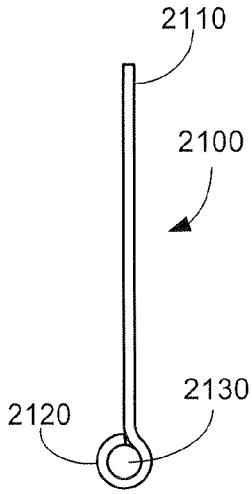
Figure 21C:
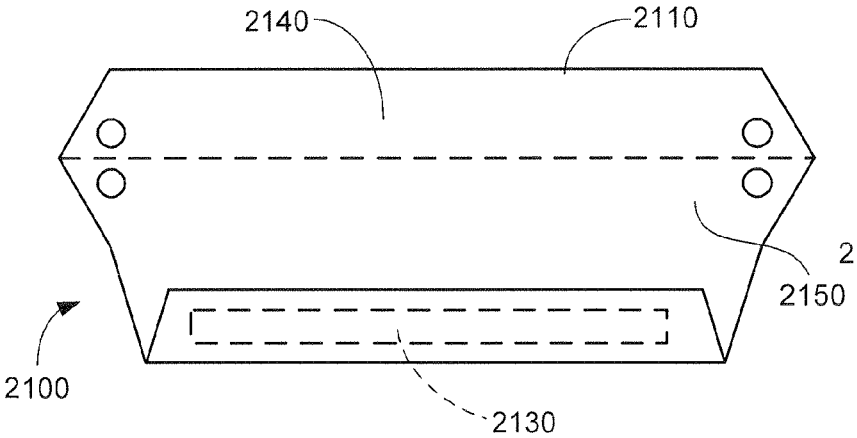
Figure 21D:
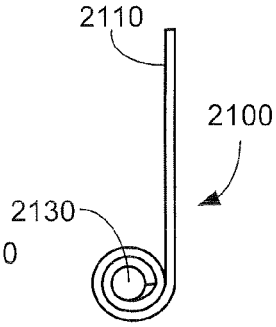

The neckpiece 2100 is transitioned from the deployed state to the retracted state by successively rolling the neckpiece material about the roll member 2130, as generally depicted in FIGS. 21C-21D, to form a flattened roll structure, as before. It will be noted that while the roll structure may retain a substantially "round" shape as the material is initially gathered, it will be nevertheless "flattened" since the proximal edge 2110 will generally conform to the curvilinear surface of the backside of the headwear, and will thus present a similar appearance as previously set forth in FIG. 8 once the stored, retraced state is reached. As before, opposing panel sections 2140, 2150 form a channel into which the roll structure is retained, and the channel is secured by closure devices 2160, 2170.

Figure 22A:
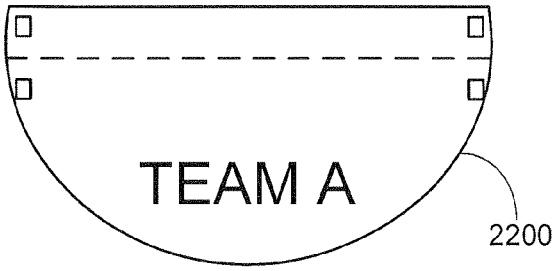
FIGS. 22A-22B generally illustrate yet another exemplary neckpiece to illustrate the use of human readable indicia.
Figure 22B:
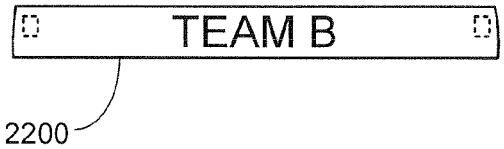

Finally, FIGS. 22A-22B demonstrate the use of human readable indicia that can be advantageously placed on a neckpiece as embodied herein. For example, FIG. 22A shows the logo for a sports organization "TEAM A" on a flap portion of a neckpiece 2200, visible from a vantage point behind the user when the neckpiece 2200 is deployed. FIG. 22B shows the neckpiece 2200 in the retracted state, with another logo, which can be for the same organization or a different organization, such as "TEAM B." The neckpiece can accordingly be used to show allegiance to the same or to different organizations, including rival teams, by selectively displaying the human readable indicia based on the state of the neckpiece (i.e., whether retracted or deployed).

The various foregoing embodiments provide a number of advantages over the prior art. The support provided by the support device 100 is upturned on the outside of the headpiece and follows the headpiece banding, and thus allows the support device and neckpiece to be used on many different kinds of headpieces without encroaching on the basic design, style or size of the headpiece when deployed or stored.

The various embodiments presented herein further allow the neckpiece to hang a selected distance from the user's head and neck, allowing airflow and cooling (or alternatively, warming) while still protecting the user's neck, ears and/or face from the elements.

Although the exemplary support device 100 will immediately fit the vast majority of all headpieces for anyone of any age, the design advantageously is provided with specific trim areas to allow it to be easily fitted to exceptionally large or small headpieces.

The exemplary designs further allow the neckpieces to be rolled from the bottom to a level even with the headpiece banding and to be stored at that level. This makes it less obtrusive on the overall aesthetic appearance of the headpiece, as well as covering the adjustment strap, if such is present on the headpiece.

The exemplary neckpieces can further be rolled with minimal "stack-up" of the roll, and thus minimizes the change in profile of the headpiece design, which further makes such less obtrusive on the design of the headpiece.

The exemplary neckpieces can be left plain to minimize the appearance and distraction from the headpiece, or can be adorned with any type or style of indicia, logos, pictures, figures, lettering, etc. Either or both can be accomplished based on the design of adornment when the neckpiece is deployed or when stored, because several different surfaces are available for those choices.

Finally, the various embodiments presented herein enable the neckpiece to be "self-stored" without any additional devices, headpiece attachments, or modifications.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. An apparatus comprising a neckpiece configured for attachment to a headwear to protect a user's neck, the neckpiece comprising a layer of flexible material with a proximal end supported adjacent the headwear, an opposing distal end configured to be suspended adjacent to a base of the user's neck and a surface therebetween, the layer of flexible material comprising a support portion formed from a laterally extending first panel that supports a first closure device on the surface and a laterally extending second panel that supports a corresponding second closure device on the same surface, the first and second panels fold together with the second panel folded upwardly to contactingly engage the second closure device to the first closure device to form an upwardly directed open V-shaped channel which circumferentially extends in contact against an outermost rearward surface of the headwear, the layer of flexible material further comprising a flap portion which extends from the second panel to the distal end and is moveable between a deployed state to cover the user's neck to a retracted state in which the flap portion is gathered into the channel.

2. The apparatus of claim 1, wherein the layer of flexible material is divided into a plurality of adjacent, laterally extending panels with fold regions therebetween, the layer of flexible material transitioned from the deployed state to the retracted state by successively folding the plurality of adjacent panels along said fold regions beginning at a first of said plurality of adjacent panels adjacent the distal edge to form a flattened roll structure that is secured within said channel.

3. The apparatus of claim 1, further comprising a flexible roll member embedded within the layer of flexible material adjacent the distal end configured to facilitate rolling of the flap portion thereabout to form a flattened roll structure that is secured within said channel.

4. The apparatus of claim 1, wherein the second panel supports a pair of corresponding second closure devices on the surface which contactingly engages a pair of first closure devices supported by the first panel on the surface supported by the headwear to close the channel and secure the flap portion therein when the neckpiece is in the retracted state.

5. The apparatus of claim 4, wherein the neckpiece has a first lateral length adjacent the proximal edge and wherein the neckpiece tapers to a second lateral length adjacent the distal edge less than the first lateral length to provide clearance for the first closure device to mate with the second closure device as the neckpiece is gathered into a flattened roll structure in the retracted state.

6. The apparatus of claim 1, further comprising human readable indicia placed on the neckpiece, the human readable indicia viewable when the neckpiece is in the retracted state from a vantage point behind the user.

7. The apparatus of claim 6, wherein the support device comprises at least one mesh area comprising an array of adjacent through-holes that extend through the support device.

8. The apparatus of claim 1, further comprising human readable indicia placed on the neckpiece, the human readable indicia placed on the flap portion so as to be viewable when the neckpiece is in the deployed state from a vantage point behind the user.

9. The apparatus of claim 1, wherein the neckpiece is permanently affixed to the headwear.

10. The apparatus of claim 1, in combination with a removable support device to which the proximal end of the neckpiece is attached, the support device configured to circumferentially extend in contact against the outermost rearward surface of the headwear.

11. The apparatus of claim 10, wherein the support device comprises a flexible, generally U-shaped structure with a laterally extending central portion along which the proximal edge of the neckpiece is attached, and opposing leg portions which extend from the central portion to engage the headwear thereby securing the support device and the neckpiece to the headwear.

12. The apparatus of claim 11, wherein each of the opposing leg portions comprises a substantially G-shape configuration with a first portion that slidingly engages an interior hatband of the headwear on a side opposite a head of the user, and an inwardly facing second portion which contactingly engages the head of the user.

13. The apparatus of claim 1, wherein a bottom of the V-shaped channel is configured to be substantially even with a bottom edge of the headwear.

14. The apparatus of claim 1, wherein the distal end includes a permanent starter strip configured as an initial guide to facilitate the flap portion gathered in the channel.

15. An apparatus, comprising:

a neckpiece configured for attachment to a headwear to protect a user's neck, the neckpiece comprising a layer of flexible material with a proximal end supported adjacent the headwear and an opposing distal end configured to be suspended adjacent a base of the user's neck, the layer of flexible material comprising a support portion formed from laterally extending first and second panels which fold together to form V-shaped channel which circumferentially extends in contact against an outermost rearward surface of the headwear, the layer of flexible material further comprising a flap portion which extends from the second panel to the distal end and is moveable between a deployed state to cover the user's neck to a retracted state in which the flap portion is gathered into the channel; and a support device configured to support the neckpiece adjacent the headwear, the support device comprising a flexible, generally U-shaped structure with a laterally extending central portion to accommodate attachment of the proximal edge of the neckpiece, and opposing leg portions which extend from the central portion to engage the headwear, the laterally extending central portion with at least one mesh area comprising an array of adjacent through-holes that extend through the support device to promote wicking of perspiration from a head of the user and enhance flexibility of the support device.

16. The apparatus of claim 15, wherein the second panel supports a closure device which contactingly engages a second closure device supported by the headwear to close the channel and secure the flap portion therein when the neckpiece is in the retracted state.

17. The apparatus of claim 15, wherein each of the opposing leg portions of the support device comprises a substantially G-shape configuration with a first portion that slidingly engages an interior hatband of the headwear on a side opposite a head of the user, and an inwardly facing second portion which contactingly engages the head of the user.

* * * * *